US006540334B1

(12) United States Patent
Mrvos et al.

(10) Patent No.: US 6,540,334 B1
(45) Date of Patent: Apr. 1, 2003

(54) METHOD FOR MAKING INK JET PRINTHEADS

(75) Inventors: Jim Michael Mrvos, Lexington, KY (US); George Keith Parish, Winchester, KY (US); Kristi Maggard Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/135,251

(22) Filed: Apr. 30, 2002

(51) Int. Cl.[7] ..... B41J 2/05
(52) U.S. Cl. ..... 347/64; 347/63
(58) Field of Search ..... 347/63, 64, 65, 347/67, 57–59, 50

(56) References Cited

U.S. PATENT DOCUMENTS

| | | | | |
|---|---|---|---|---|
| 4,862,197 A | | 8/1989 | Stoffel | 347/59 |
| 4,965,611 A | | 10/1990 | Pan et al. | 347/64 |
| 5,159,353 A | | 10/1992 | Fasen et al. | 347/59 |
| 5,491,505 A | | 2/1996 | Suzuki et al. | 347/50 |
| 5,580,468 A | | 12/1996 | Fujikawa et al. | 347/58 |
| 5,635,966 A | | 6/1997 | Keefe et al. | 347/43 |
| 5,635,968 A | | 6/1997 | Bhaskar et al. | 347/59 |
| 5,636,966 A | * | 6/1997 | Keee et al. | 347/43 |
| 5,666,140 A | | 9/1997 | Mitani et al. | 347/12 |
| 5,697,144 A | | 12/1997 | Mitani et al. | 347/65 |
| 5,821,960 A | | 10/1998 | Mitani | 347/58 |
| 6,062,679 A | | 5/2000 | Meyer et al. | 347/63 |
| 6,155,675 A | | 12/2000 | Nice et al. | 347/63 |
| 6,155,676 A | | 12/2000 | Etheridge, III et al. | 347/63 |
| 6,180,018 B1 | | 1/2001 | Miyagawa et al. | 347/63 |
| 6,378,978 B1 | * | 4/2002 | Chang et al. | 347/64 |

* cited by examiner

*Primary Examiner*—Lamson Nguyen
*Assistant Examiner*—Juanita Stephens
(74) *Attorney, Agent, or Firm*—David E. LaRose; Jacqueline M. Daspit

(57) ABSTRACT

The invention provides a method for reducing ink corrosion of exposed metal layers on a chip surface of a semiconductor chip for an ink jet printhead. The method includes depositing a protective layer in a plasma process to the chip surface, the protective layer being deposited adjacent ink ejectors so that the protective layer substantially circumscribes an ink via in the chip. A thick film layer is applied to the protective layer and chip, whereby the protective layer and thick film layer are sufficient to promote increased adhesion between the thick film layer and a nozzle plate attached to the thick film layer thereby substantially reducing a tendency for the nozzle plate and thick film layer to delaminate from one another during printhead manufacture or use and interrupting contact between ink and the exposed metal layers on the chip surface.

11 Claims, 7 Drawing Sheets

METHOD FOR MAKING INK JET PRINTHEADS

TECHNICAL FIELD

This invention relates to the field of ink jet printheads and in particular, to printheads having enhanced corrosion protection.

BACKGROUND OF THE INVENTION

Ink jet printheads contain semiconductor chips which are electrically activated to eject ink droplets on demand through nozzle holes in a nozzle plate attached to the chips. In a "roof shooter" type printhead, ink is provided to the active surface of the chips for ink droplet ejection through ink vias or ink feed slots formed through the thickness dimension of the silicon chips. The ink ejection devices are typically located in close proximity to the ink feed via or slot along opposing sides thereof for the length of the ink feed via or slot. Metal conducting traces or lines are provided on the chip adjacent the ink feed slots to provide power to the ink ejection devices. Because of the corrosive nature of the ink, the ink ejection devices and metal traces should be protected from the ink. A variety of layers of protective material may be used to provide protection against corrosion for the ink ejection devices and metal conducting layers. However, despite the use of protective layers over the ejection devices and metal layers, ink often gets between the nozzle plate and a planarizing layer on the chip causing delamination between the nozzle plate and planarizing layer. Once delamination has occurred, the ink may find its way to the chip surface thereby corroding unprotected metal conducting layers. There is a need therefore for improved methods for protecting the metal conducting layers on an ink jet chip from ink corrosion and damage.

SUMMARY OF THE INVENTION

The foregoing and other needs are provided by a method for reducing ink corrosion of exposed metal layers on a chip surface of a semiconductor chip for an ink jet printhead, the chip having an elongate ink feed via and ink ejectors adjacent the ink feed via. The method includes depositing a protective layer in a plasma process to the chip surface, the protective layer being deposited adjacent the ink ejectors so that the protective layer substantially circumscribes the ink via. A thick film layer is applied to the protective layer and chip, whereby the protective layer and thick film layer are sufficient to promote increased adhesion between the thick film layer and a nozzle plate attached to the thick film layer thereby substantially reducing a tendency for the nozzle plate and thick film layer to delaminate from one another during printhead manufacture or use and interrupting contact between ink and the exposed metal layers on the chip surface.

In another aspect the invention provides a semiconductor chip for an ink jet printhead, the chip having a chip surface, an elongate ink via therein, ink ejectors on the chip surface adjacent the ink via, metal conductive traces attached to the ink ejectors and a protective layer deposited adjacent the ink ejectors. The protective layer substantially circumscribes the ink via and provides an improved seal between a thick film layer and a nozzle plate attached to the thick film layer sufficient to inhibit delamination and ink flow between the thick film layer and the nozzle plate.

An important aspect of the invention is that the protective layer extends completely around the ink via region thereby forming a seal "ring" for improved adhesion of the thick film layer to the nozzle plate. The protective layer is advantageously wide enough to reduce instances of delamination between the nozzle plate and thick film layer and subsequent ink corrosion of exposed metal outside of the seal ring area. Because the seal ring may be deposited by typical semiconductor processing techniques, an improved adhesion between the nozzle plate and the thick film adjacent the ink via area may be provided without resorting to exotic adhesives or other multi-step methods for improving adhesion. Furthermore, the width of the seal ring may be easily adjusted to provide more or less adhesion promotion surface.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
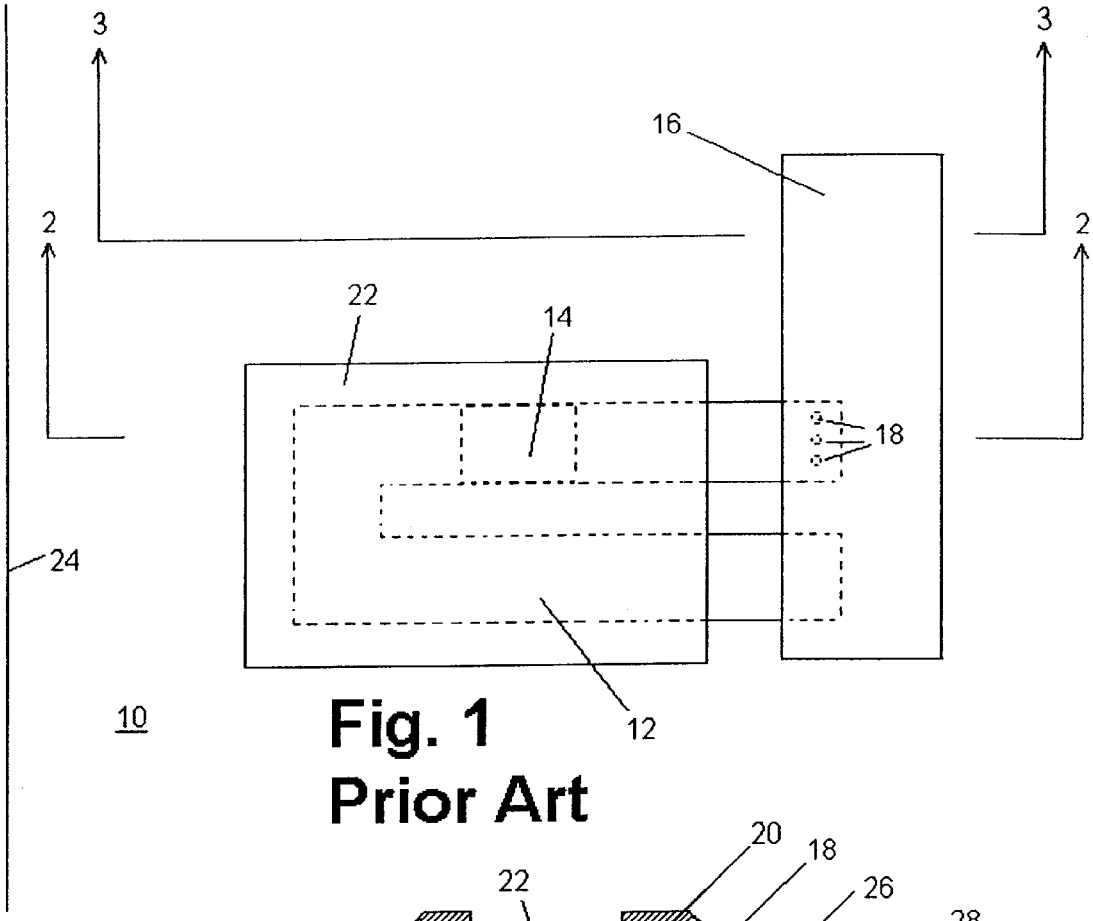
Fig. 1 Prior Art
FIG. 1 is a plan view, not to scale, of a portion of a conventional printhead chip.
Figure 2:
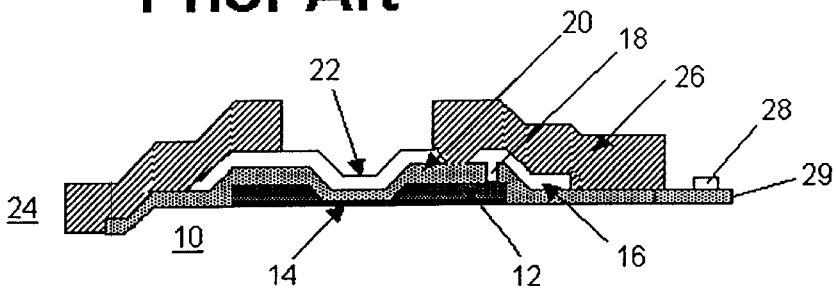
Fig. 2 Prior Art
FIG. 2 is a cross-sectional view, not to scale, of a portion of a conventional printhead chip through lines 2—2 of FIG. 1.
Figure 3:
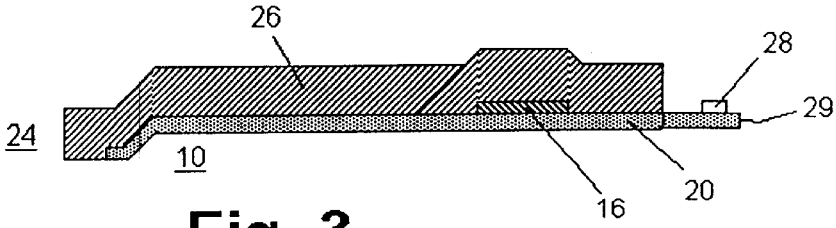
Fig. 3 Prior Art
FIG. 3 is a cross-sectional view, not to scale, of portion of a conventional printhead chip through lines 3—3 of FIG. 1.
Figure 4:
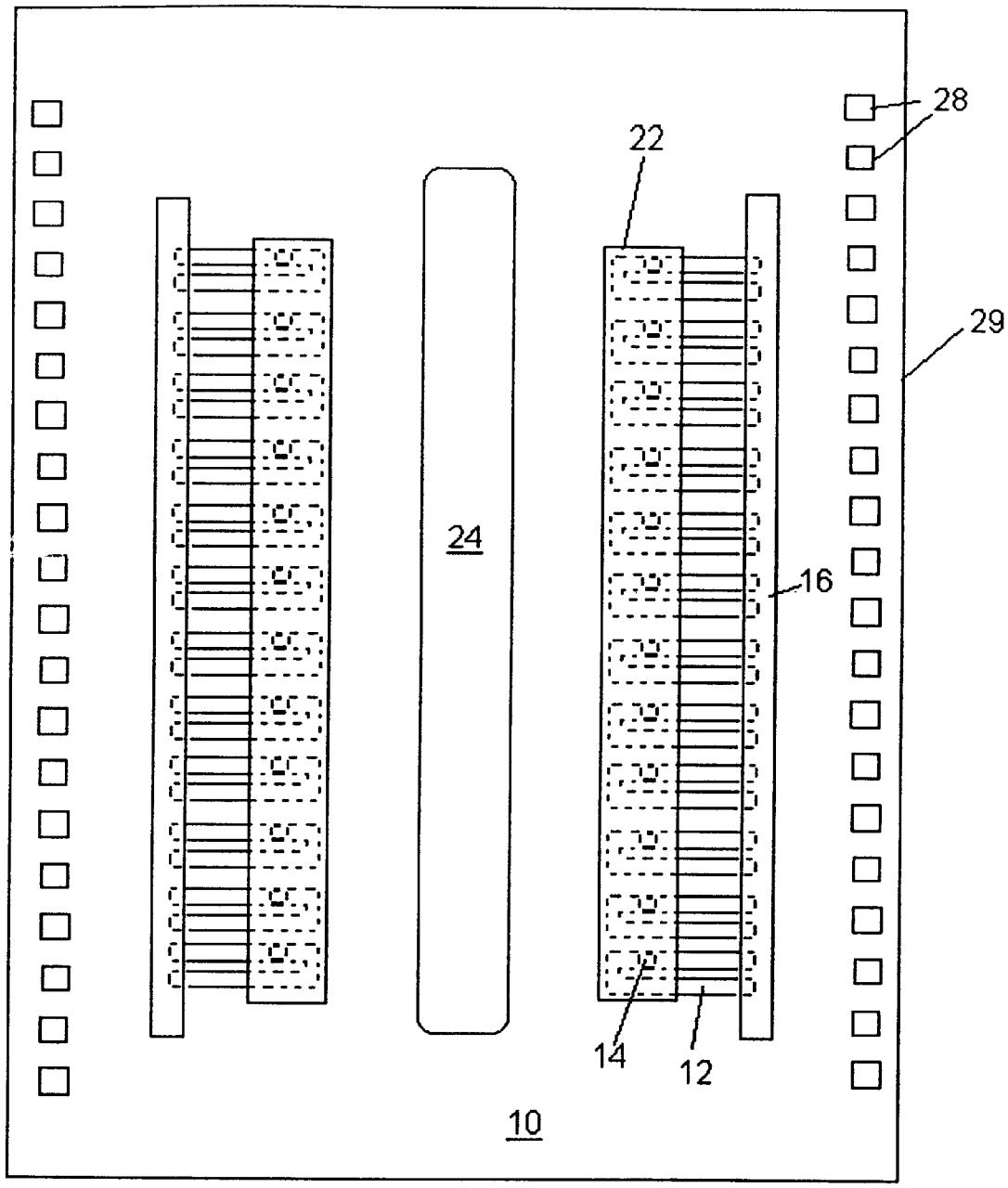
Fig. 4 Prior Art
FIG. 4 is a plan view, not to scale, of a conventional printhead chip.

Ink jet printheads of the thermal drop on demand type typically use semiconductor silicon chips containing a plurality of insulating, conductive, resistive, passivation and/or cavitation layers which together provide an active layer for ejecting ink. The conductive layers typically include metal materials which are susceptible to ink corrosion. Accordingly, a variety of passivating and insulating layers are applied to the metal layers to reduce or prevent damage to the metal layers caused by ink corrosion. However, not all of the layers are adequately protected from ink as ink may find a path between the nozzle plate and thick film layer applied to the chip surface. FIGS. 1–3 illustrate portions of a prior art printhead chip 10 and FIG. 4 is a plan view of a prior art chip viewed from a nozzle plate side thereof. In FIG. 1, the chip 10 is also viewed from the nozzle plate side thereof while FIGS. 2 and 3 are selected cross-sectional views through portions of the layers on the chip surface. The chip 10 includes a first metal conductive layer 12 which provides an electrical conductive path to both sides of a heater resistor 14. A second metal conductive layer 16 is electrically connected to one side of the resistor 14 by connections 18 which pass through an insulation or passivation layer 20 disposed between the conductive layers 12 and 16. A cavitation layer 22 is applied to the chip 10 to cover at least the heater resistor 14 and may be extended to cover other portions of the first metal layer 12.

The metal layers 12 and 16 are spaced from an ink via 24 (a portion of which is shown in FIG. 1). The ink via 24 is typically a slot which is formed through the chip 10 so as to provide a flow path for ink from an ink reservoir to the surface of the chip 10 containing the heater resistors 14. For convenience only, the printhead chip will be described as containing a single ink via 24. However, the invention is applicable to printhead chips containing more than one ink via 24.

The chip 10 is preferably made of a silicon material having a thickness ranging from about 200 to about 800 microns. The insulative, conductive and resistive layers on the surface of the chip 10 preferably have an overall thickness ranging from about 1 micron to about 5 microns, most preferably from about 2 to about 3 microns. Such layers are deposited on the chip surface by conventional semiconductor processing techniques.

With regard to depositing the insulative, conductive and resistive layers to provide the printhead chip 10, generally, the silicon substrate is first insulated with a layer of material which is preferably an oxide layer, most preferably silicon dioxide having a thickness ranging from about 8,000 Angstroms to about 10,000 Angstroms. A phosphorous silicon glass (PSG) or boron impregnated PSG layer having a thickness ranging from about 7,500 to about 9,500 Angstroms may be preferably deposited over the insulating layer. A resistive material of tantalum/aluminum, or tantalum is next deposited on at least a portion of the PSG layer or on the silicon dioxide layer. The resistive material provides the heater resistors 14 which upon activation urge ink to be ejected through the nozzle holes in the nozzle plate attached to the chip. The resistive material preferably has a thickness ranging from about 900 to about 1100 Angstroms.

Metal conductive layer 12 made of an aluminum/copper alloy, gold, aluminum and the like is deposited on one or more portions of the resistive layer to provide electrical connection between the resistors 14 and a printer controller. The conductive layer 12 preferably has a thickness ranging from about 5000 to about 6000 Angstroms.

In order to protect the conductive layers 12 and resistors 14 from ink corrosion, a passivation layer 20 is preferably deposited over the resistors 14 and the first metal conductive layer 12. The passivation layer 20 may be a composite layer of silicon nitride and silicon carbide, or may be individual layers of silicon nitride and silicon carbide, respectively. The passivation layer 20 is preferably deposited directly on the first metal conductive layer 12 and the resistors 14. It is preferred that the silicon carbide layer have a thickness ranging from about 1,200 to about 3,000 Angstroms, most preferably from about 2,600 Angstroms. The silicon nitride layer preferably has a thickness ranging from about 2,600 to about 5,000 Angstroms, most preferably about 4,400 Angstroms.

The cavitation layer 22 or additional passivation layer of tantalum is preferably deposited over at least a portion of the passivation layer 20, most preferably adjacent the heater resistor 14. The cavitation layer 22 provides protection to the heater resistors 14 during ink ejection operations which could cause mechanical damage to the heater resistors 14 in the absence of the cavitation layer 22. The cavitation layer 22 is believed to absorb energy from a collapsing ink bubble after ejection of ink from the nozzle holes. The cavitation layer 22 thickness may range from about 2,500 to about 7,000 Angstroms or more, preferably from about 4,000 to about 6,000 Angstroms.

An adhesion promotion layer (not shown) may be provided to enhance the adhesion between a thick film layer 26 and the surface of the chip 10 containing the insulative, conductive and resistive layers. A preferred adhesion promotion layer is derived from a silane material provided by a spin-coat process from a solution of the silane material in alcohol. When used, the adhesion promotion layer should be of a thickness sufficient to promote adhesion between the thick film layer 26 and the surface of the chip 10.

The thick film layer 26 is preferably applied to the chip 10 to provide a surface for attachment of a nozzle plate to the chip 10. The thick film layer 26 may be derived from a radiation and/or heat curable polymeric film material preferably containing a difunctional epoxy material, a polyfunctional epoxy material and suitable cure initiators and catalyst. A particularly preferred thick film layer 26 is a polymeric photoresist material described in U.S. Pat. No. 5,907,333 to Patil et al., the disclosure of which is incorporated herein by reference as if fully set forth. The thick film layer 26 has a thickness ranging from about 2 to about 3 microns.

With reference to FIG. 4, a plan view of the chip 10 as viewed from the nozzle plate side thereof is illustrated. Each chip 10 includes a plurality of heater resistors 14 and first metal conductors layer 12 connected to the heater resistors 14. As seen in FIG. 4, the first metal conductor layer 12 is typically adequately protected by the passivation/cavitation layer 20/22. However, the second metal layer 16 as well as bond pads 28 adjacent longitudinal edges 29 of the chip may be exposed to ink from the ink via 24. The bond pads 28 are typically not covered by the thick film layer 26 as illustrated in FIG. 3. Accordingly, if there is poor adhesion or slight delamination between the thick film layer 26 and a nozzle plate attached to the thick film layer 26, ink may be able to contact and corrode the second metal layer 16 and/or unprotected bond pads 28.

Figure 5:
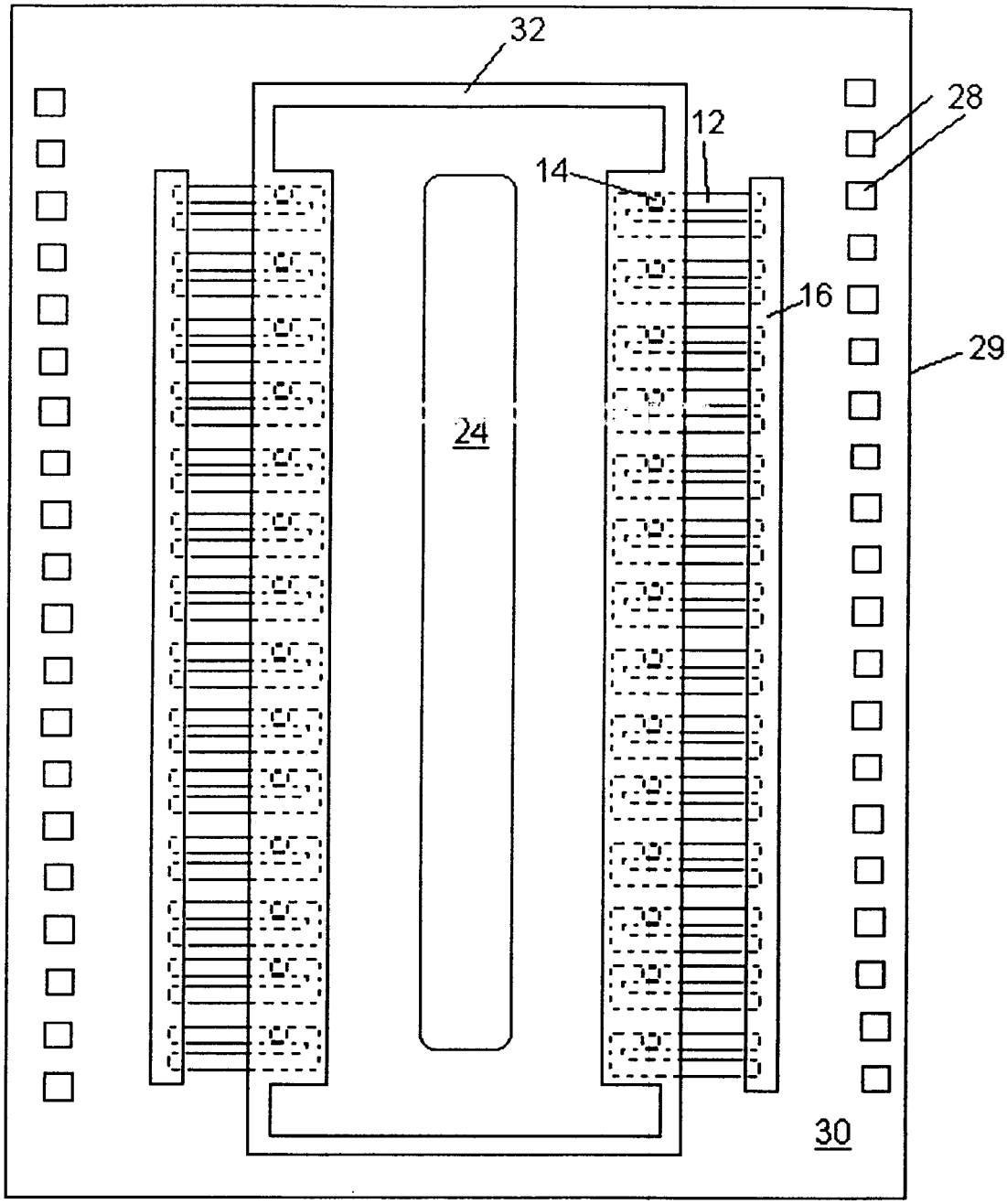
FIG. 5 is a plan view, not to scale, of a printhead chip according to the invention.
Figure 6:
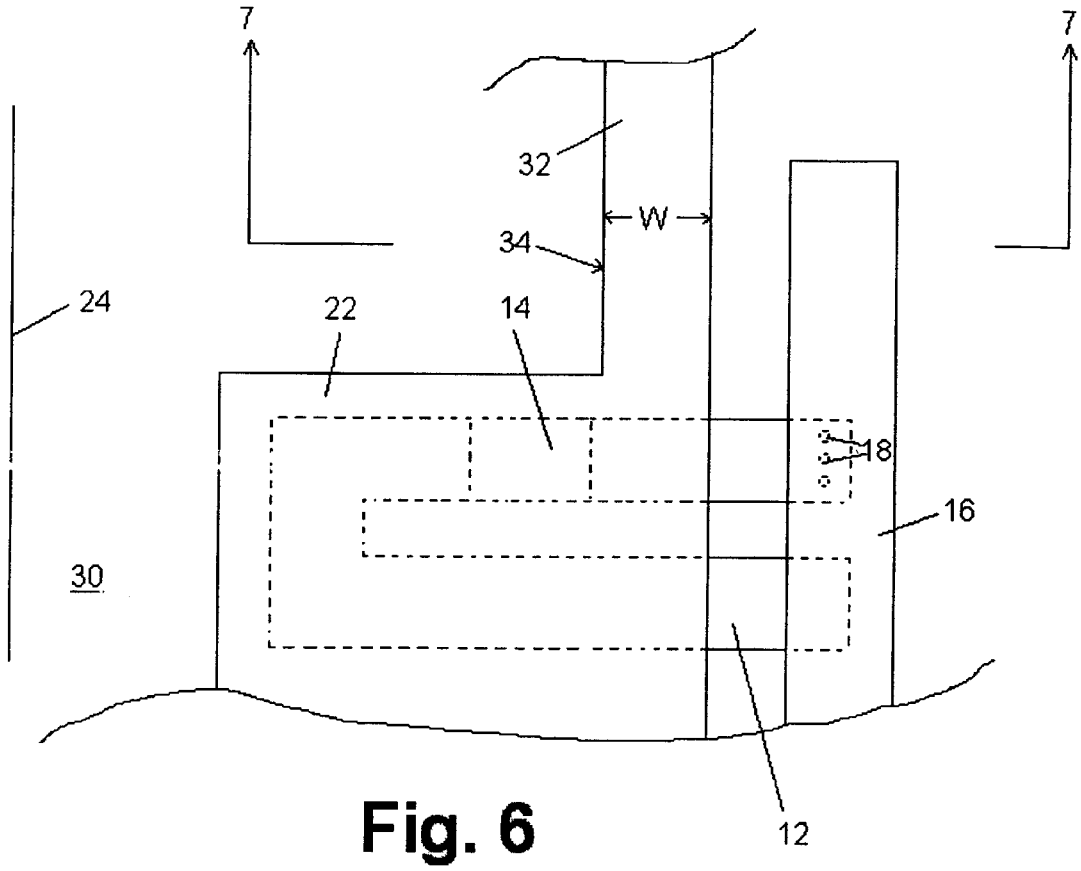
FIG. 6 is a plan view, not to scale, of a portion of a printhead chip according to the invention.
Figure 7:
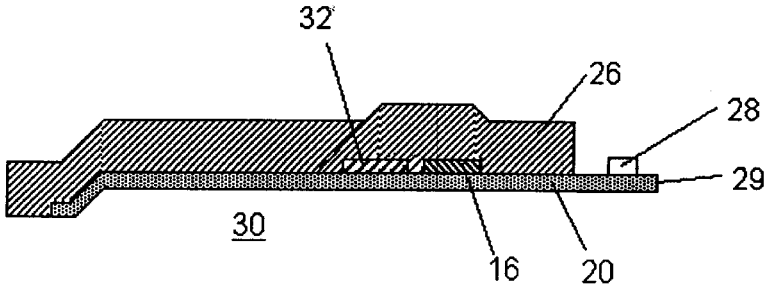
FIG. 7 is a cross-sectional view, not to scale, of a portion of a printhead chip through lines 7—7 of FIG. 6.

In view of the problems associated with conventional printhead manufacturing techniques, a printhead chip 30 is provided according to one embodiment of the invention as illustrated in FIGS. 5–7. As with a conventional chip 10, chip 30 also contains the first metal conductive layer 12, heater resistors 14, a second metal conductive layer 16, connections 18 between the metal layers 12 and 16, passivation layer 20 and cavitation layer 22. However, unlike a conventional printhead chip 10, the cavitation layer 22 is extended to provide a ring 32 of cavitation layer material circumscribing the ink via 24. The ring 32 effectively promotes increased adhesion between the thick film layer 26 and a nozzle plate attached to the thick film layer 26 to reduce instances of delamination between the nozzle plate and thick film layer 26 so that ink is inhibited from contacting the second metal layer 16 and unprotected bond pads 28 adjacent longitudinal edges 29 of the chip.

In order to provide the seal ring 32 with sufficient adhesion promoting characteristics, the seal ring width W preferably ranges from about 20 to about 60 microns and may extend as wide as cavitation layer 22 as it circumscribes ink via 24. The thickness of the seal ring 32 is preferably the same as the thickness of the cavitation layer 22 described above and thus may be formed by extending the cavitation layer 22 during the cavitation layer 22 deposition process. Because the seal ring 32 is deposited on the passivation layer 20, the seal ring 32 provides a raised topography above the plane of the passivation layer 20 thereby promoting a raised topography of the thick film layer 26 applied to the seal ring 32 and passivation layer 20 as shown in FIG. 7. While the width of the seal ring 32 preferably ranges from 20 to 60 microns, the seal ring may also be extended toward the ink via 24 so that edge 34 of the seal ring closest to the ink via 24 does not cause the raised topography of the thick film layer 26 to be disposed in a nozzle plate flow feature area as described in more detail below.

Figure 8:
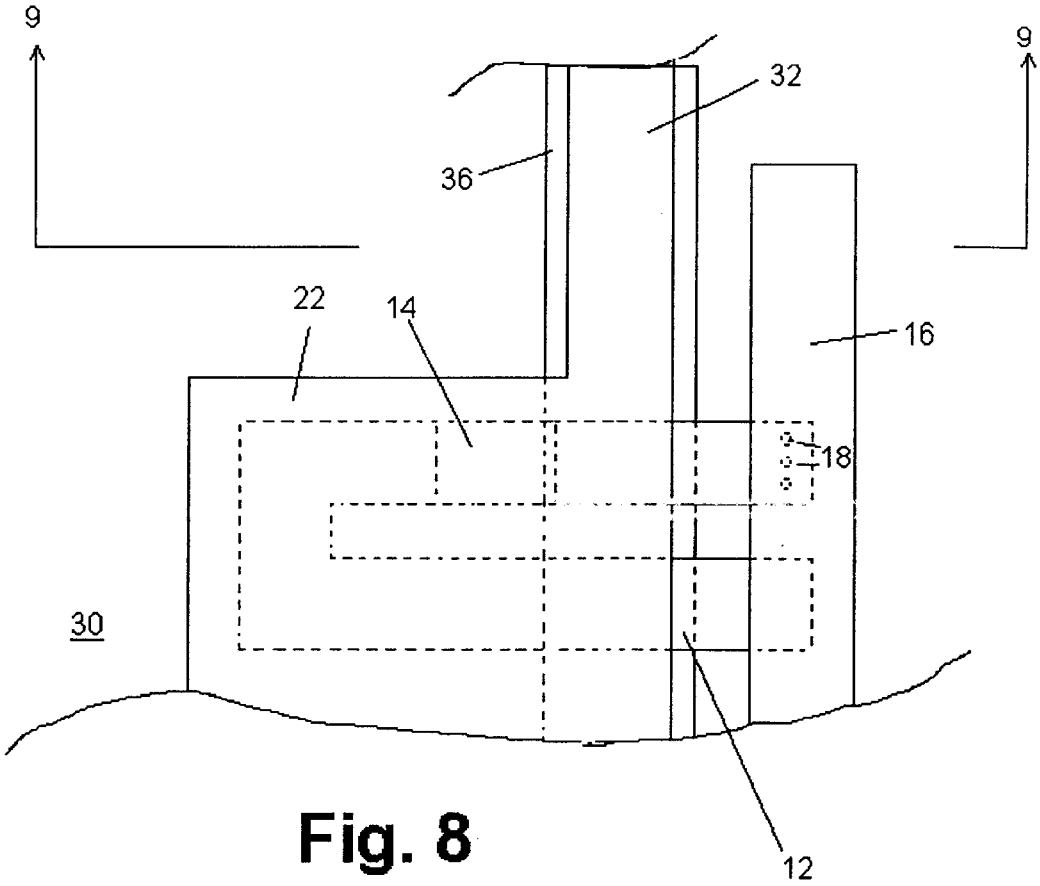
FIG. 8 is a plan view, not to scale, of a portion of a printhead chip according to a second embodiment of the invention.
Figure 9:
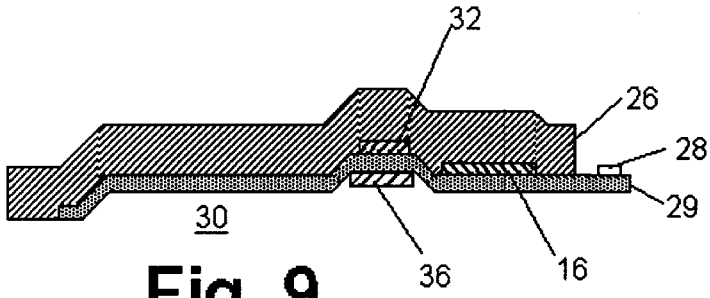
FIG. 9 is a cross-sectional view, not to scale, of a portion of a printhead chip through lines 9—9 of FIG. 8.
Figure 10:
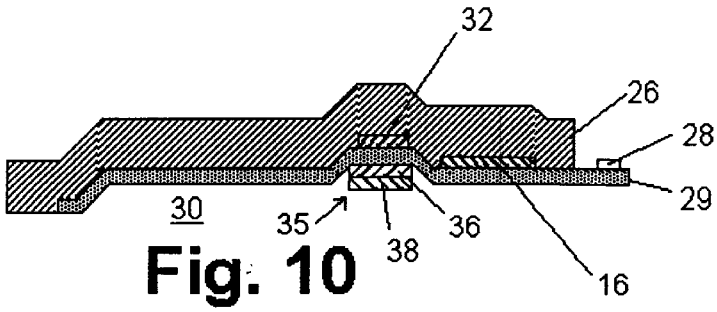
FIG. 10 is a cross-sectional view, not to scale, of a portion of a printhead chip according to a third embodiment of the invention.

If it is desired to further increase the height of the seal ring 32 and thick film layer 26 without increasing the thickness of the cavitation layer 22, a seal promoting layer 35 selected from a third metal layer 36, a polycrystalline layer 38 or both the third metal layer 36 and the polycrystalline layer 38 may be deposited on the surface of the chip 30 before depositing the passivation layer 20 on the chip as illustrated in FIGS. 8–10. The third metal layer 36 may the same as the metal conductive layer 12, or may independently be selected from aluminum/copper alloys, gold and aluminum. A preferred metal layer 36 is an aluminum/copper alloy and a preferred polycrystalline layer 38 is polysilicon.

Each of the polycrystalline layer 38 and third metal layer 36 may be deposited by conventional semiconductor processing techniques such as sputter, spin coating and the like, followed by etching if necessary to provide the desired shape and width thereof. It is preferred that the third metal layer 36 and/or polycrystalline layer 38 be deposited only in an area which is underneath the seal ring 32. Accordingly, the third metal layer 36 and polycrystalline layer 38 have a width similar to the width of the seal ring 32. The thickness of each of the third metal layer 36 and polycrystalline layer 38 preferably ranges from about 3000 Angstroms to about 6000 Angstroms. Accordingly, these layers further increase the height of the seal ring 32 and provide additional sealing area for the thick film layer 26 to the nozzle plate.

Figure 11:
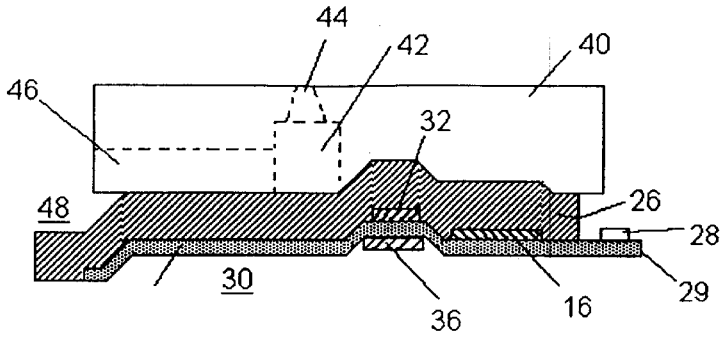
FIG. 11 is a cross-sectional view, not to scale, of a portion of a printhead chip and nozzle plate assembly.
Figure 12:
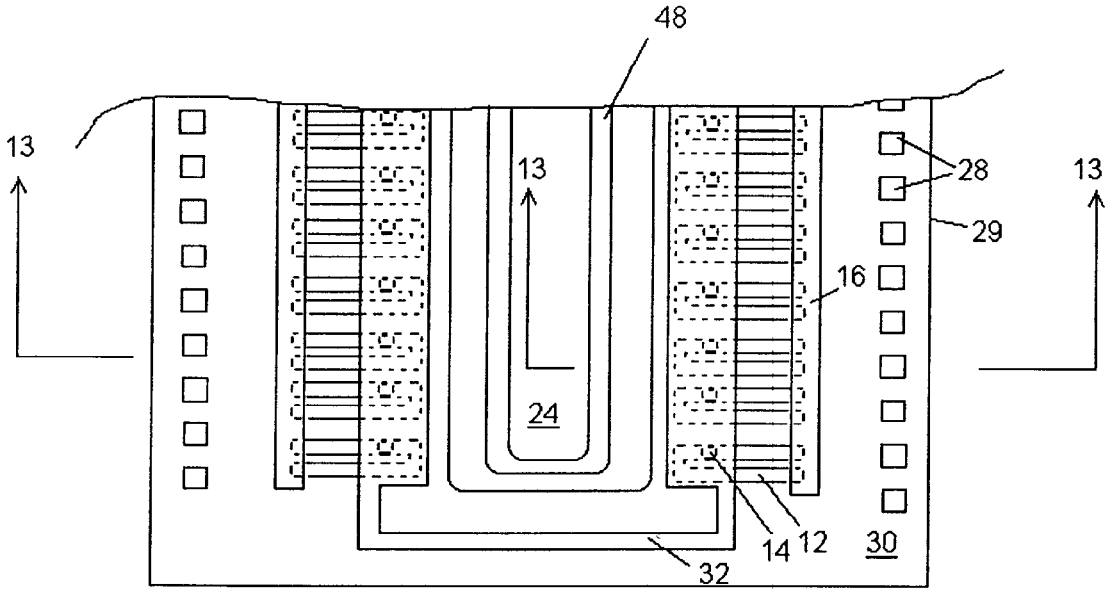
FIG. 12 is a plan view, not to scale, of a portion of a printhead chip.
Figure 13:
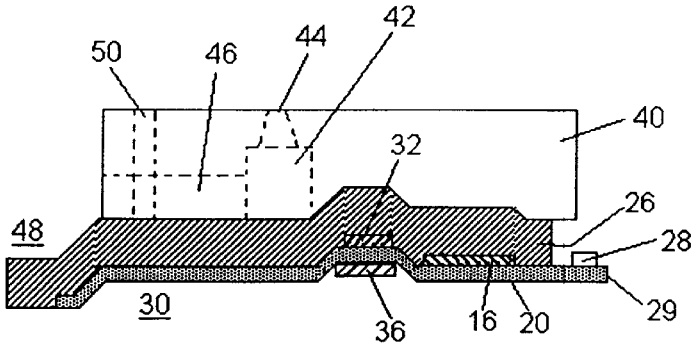
FIG. 13 is a cross-sectional view, not to scale of a portion of a printhead chip and nozzle plate assembly according to another embodiment of the invention.

With reference now to FIGS. 11–13, a nozzle plate 40 is then preferably adhesively attached to the thick film layer 26 to provide a nozzle plate/chip assembly. The nozzle plate 40 may be made of metals or plastics and is preferably made of a polyimide polymer containing an adhesive layer which materials are laser ablated to provide flow features, namely, ink chambers 42, nozzle holes 44 and ink supply channels 46 therein.

The adhesive used to attach the nozzle plate 40 to the thick film layer 26 is any B-stageable material, including some thermoplastics. Examples of B-stageable thermal cure resins include phenolic resins, resorcinol resins, urea resins, epoxy resins, ethylene-urea resins, furane resins, polyurethanes, and silicone resins. Suitable thermoplastic, or hot melt, materials include ethylene-vinyl acetate, ethylene ethylacrylate, polypropylene, polystyrene, polyamides, polyesters and polyurethanes. The adhesive is preferably applied with a thickness ranging from about 5 to about 15 microns and the polyimide has a thickness preferably ranging from about 25 to about 50 microns. In the most preferred embodiment, the adhesive is a phenolic butyral adhesive such as that used in RFLEX R1100 or RFLEX R1000 films, commercially available from Rogers of Chandler, Ariz.

As shown in FIG. 11, a portion of the ink feed channel 46 may overlap a region 48 which is adjacent the ink via 24. The overlap of the ink channel 46 into the ink via region 48 may provide areas of increased susceptibility to delamination between the nozzle plate 40 and the thick film layer 26 as this area is susceptible to forming air pockets during assembly and use of the printheads. However, if the nozzle plate is attached to the chip 30 so that the ink flow channel 46 does not overlap via region 48, there is decreased likelihood that gaps or air pockets will develop between the nozzle plate and the thick film layer 26 in the area adjacent the ink via region 48.

Figure 14:
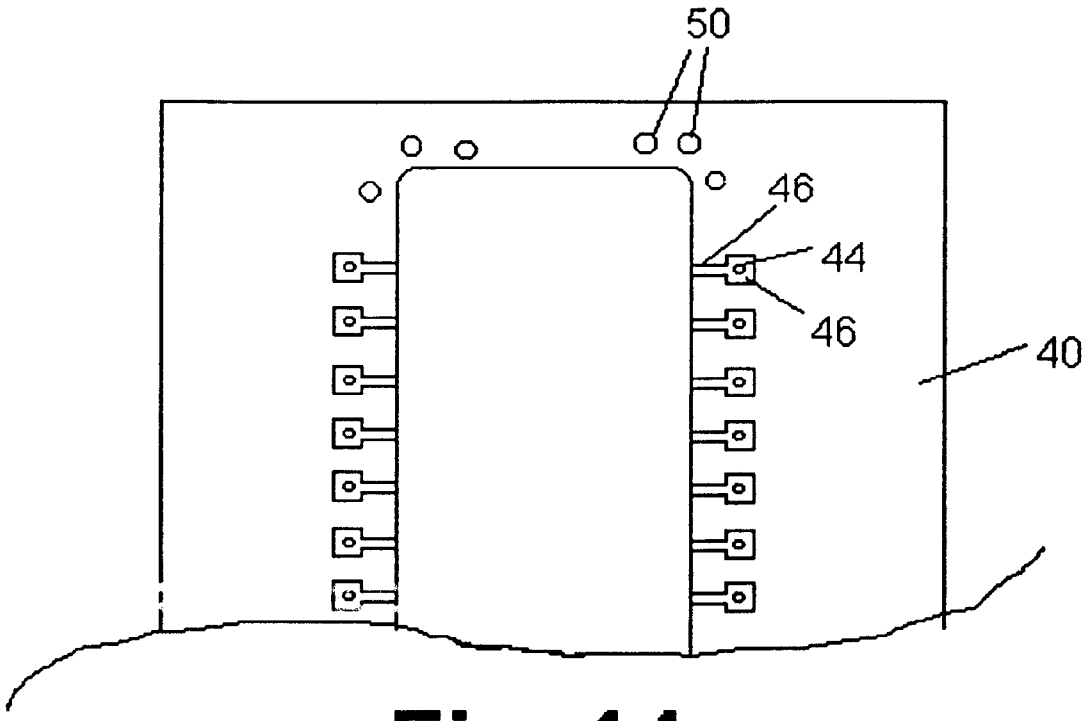
FIG. 14 is a plan view, not to scale of a portion of a nozzle plate according to one embodiment of the invention.

As an additional provision to enhance the adhesion between the nozzle plate 40 and the thick film layer 26, vent holes 50 may be formed in the nozzle plate 40 to provide release of trapped air which may cause delamination. A plan view of a portion of a nozzle plate 40 viewed from the chip side thereof is illustrated in FIG. 14 showing the preferred location of vent holes 50 which are formed through the entire thickness of the nozzle plate 40. The vent holes 50 may be formed by conventional micromachining techniques such as etching, laser ablation and the like.

To complete the printhead chip 30, a flexible circuit or tape automated bonding (TAB) circuit is attached to the nozzle plate/chip assembly to provide a nozzle plate/chip/circuit assembly. The nozzle plate/chip/circuit assembly is preferably adhesively attached to a printhead body portion to provide a printhead for an ink jet printer. The nozzle plate/chip assembly may be attached as by means of a die bond adhesive, preferably a conventional die bond adhesive such as a substantially transparent phenolic polymer adhesive which is commercially available from Emerson & Cuming of Monroe Township, N.J. under the trade name ECCOBOND 3193-17, preferably in a chip pocket of a printhead body portion. The flexible circuit or TAB circuit is adhesively attached to surface of the printhead body portion after attaching the nozzle plate/chip assembly in the chip pocket.

It is contemplated, and will be apparent to those skilled in the art from the preceding description and the accompanying drawings, that modifications and changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A semiconductor chip for an ink jet printhead, said chip having a chip surface, an elongate ink via therein, ink ejectors on the chip surface adjacent the ink via, metal conductive traces attached to the ink ejectors and a protective layer deposited adjacent the ink ejectors, the protective layer substantially circumscribing the ink via and having a height sufficient to provide a seal between a thick film layer and a nozzle plate attached to the thick film layer to promote adhesion between the thick film layer and nozzle plate and to reduce ink corrosion of exposed metal on the chip surface.

2. The semiconductor chip of claim 1 wherein the protective layer comprises a cavitation layer which is extended to substantially circumscribe the ink via and substantially cover exposed metal layers on the chip surface adjacent the ink via.

3. The semiconductor chip of claim 1 wherein the nozzle plate includes flow features therein and the nozzle plate is attached to the chip and thick film layer so that the flow features lie substantially outside of a recessed area adjacent the ink via.

4. The semiconductor chip of claim 1 wherein the protective layer comprises a cavitation layer which is extended to substantially circumscribe the ink via.

5. The semiconductor chip of claim 1 wherein the protective layer comprises tantalum.

6. The semiconductor chip of claim 1 further comprising a seal promoting layer selected from the group consisting of a metal layer, a polycrystalline material layer, and a combination of metal layer and polycrystalline layer deposited on the chip surface prior to depositing a cavitation layer on the chip surface, the seal promoting layer being sufficient to substantially increase the height of the protective layer above a plane defined by the ink ejectors.

7. The semiconductor chip of claim 6 wherein the seal promoting layer comprises a polycrystalline material layer composed of polysilicon.

8. The semiconductor chip of claim 6 wherein the seal promoting layer comprises a metal layer composed of an alloy of aluminum and copper.

9. A printhead containing a semiconductor chip of claim 6, the printhead having enhanced corrosion protection.

10. A printhead containing a semiconductor chip of claim 1, printhead having enhanced corrosion protection.

11. The printhead of claim 10 containing more than one ink via and protective layers substantially circumscribing each ink via.

* * * * *